United States Patent [19]

Fischer

[11] 4,304,359

[45] Dec. 8, 1981

[54] RAIL FASTENER

[75] Inventor: Richard L. Fischer, Bolingbrook, Ill.

[73] Assignee: Portec, Inc., Oak Brook, Ill.

[21] Appl. No.: 115,931

[22] Filed: Jan. 28, 1980

[51] Int. Cl.[3] ..... E01B 9/30

[52] U.S. Cl. ..... 238/349

[58] Field of Search ..... 238/310, 338, 349, 351

[56] References Cited

U.S. PATENT DOCUMENTS

| | | | |
|---|---|---|---|
| 3,065,914 | 11/1962 | Rigby | 238/349 |
| 4,073,435 | 2/1978 | Miller | 238/349 |
| 4,119,271 | 10/1978 | Campbell | 238/349 X |

FOREIGN PATENT DOCUMENTS

| | | | |
|---|---|---|---|
| 228255 | 7/1963 | Austria | 238/351 |
| 1059190 | 2/1967 | United Kingdom | 238/349 |

*Primary Examiner*—Randolph A. Reese

*Attorney, Agent, or Firm*—Emory L. Groff, Jr.

[57] ABSTRACT

A rail fastener includes a spring clip of unitary rod-like construction having a mounting leg retained by an anchor member fixed relative a cross-tie. The clip leg is joined to an arm bearing upon the anchor member with the arm then joined to an arcuate loop crossing over the mounting leg diagonally thereto. The clip terminates in a rail arm engaging the base flange of a rail with a substantial downward clamping pressure being applied thereto. The clip mounting leg may be an integral enlargement forming a diameter to provide a mating fit within a bore through the anchor member or alternatively, the clip mounting leg may support a separate sleeve having an outer diameter mating with the anchor member bore.

15 Claims, 5 Drawing Figures

RAIL FASTENER

This invention relates generally to railway appliances and more particularly, to an improved simplified rail fastener for securing railway rails to cross-ties.

The present rail fastener includes a resilient metal clip formed from steel rod or bar stock to provide a unitary member adapted to cooperate with an anchor or shoulder member fixedly disposed adjacent a rail base flange for the purpose of removably securing the clip in a use position with a portion of the clip in an overlying and biasing manner upon the upper surface of one of the rail base flanges. As thusly installed, the spring clip and anchor member serve to reduce longitudinal creeping of the rail as well as inhibit pumping of the cross-tie into the ballast as is normally caused by wave motion of the rail due to passage of traffic thereover.

A related environment will be found in U.S. Pat. No. 4,067,495 issued Jan. 10, 1978 to the same assignee as the present invention. The referenced patent discloses a unitary spring clip which is symmetrical about its center line and includes a first portion engaging the anchor member and joined to a second portion engaging the rail base flange. With the present fastener, a nonsymmetrical clip is provided which still includes the two portions respectively engaging the anchor member and rail base flange, but provides a distinctive improved connection between these two portions comprising a diagonally disposed cross-over arm or loop and additionally, requires but a single mounting leg for attachment to the anchor member rather than a pair of mounting legs as in the referenced patent.

The single mounting leg of the present device is intended to be adapted to provide a suitably close mating fit within a cylindrical bore formed in the anchor member, an arrangement which may be accomplished by various means. One such arrangement comprises the formation of the clip mounting leg with an enlarged periphery that is, a diameter substantially greater than the remainder of the unitary metal stock forming the spring clip. Another arrangement comprises the provision of a spring clip having a constant diameter throughout its integral body but wherein, the mounting leg is provided with a separate enveloping sleeve, having an external diameter providing a suitably close fit within the cylindrical bore of the anchor member. Additional means are intended to be included to insure an adequately insulated rail fastener assembly. These include an appropriate dielectric insulation element intermediate the anchor member and rail flange, serving to isolate the anchor member and its mounted spring clip from the rail base flange.

Accordingly, one of the primary objects of the present invention is to provide an improved rail fastener including a spring clip formed of unitary bar or rod stock and having a single mounting leg attached to an anchor member affixed adjacent the rail base flange.

Another object of the present invention is to provide an improved rail fastener including a spring clip having a mounting leg fixed adjacent a rail flange and including a parallel arm engaging the shoulder on one side of the leg and which in turn is joined by means of a diagonally disposed cross-over arm to a rail engaging arm biased against the rail flange.

An additional object of the present invention is to provide an improved rail fastener spring clip including an intermediate leg bounded by outermost and innermost arms joined respectively by a diagonally extending cross-over arm.

A further object of the present invention is to provide an improved rail fastener including a spring clip anchored adjacent a rail flange by means of a mounting leg disposed within the bore of a shoulder member and wherein the mounting leg is provided with a metal sleeve forming a close sliding fit within the shoulder member bore.

Still another object of the present invention is to provide an improved rail fastener including a spring clip of rod stock having a mounting leg of a larger diameter than the balance of the spring clip to provide a close mating fit within the bore of a shoulder member fixedly disposed adjacent a rail base flange.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
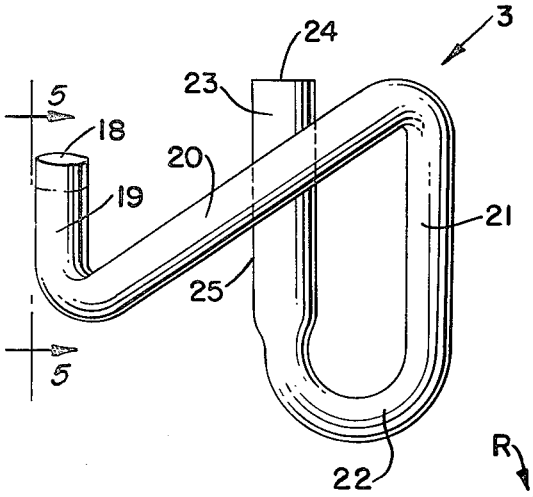
FIG. 1 is a top plan view of the spring clip according to the present invention.

Referring now to the drawing, the present invention will be seen to comprise an improved rail fastener, generally designated 1 or 1', each including two principal components, namely an anchor or shoulder member 2 and a spring clip 3 or 3'. The shoulder member or insert 2 serves as means for fixedly attaching and retaining the spring clip in the position shown in FIGS. 2 and 4 of the drawing and includes a base 4 fixedly disposed upon the top 5 of a cross-tie 6 adjacent the edge 7 of a rail base flange 8. The shoulder insert 2 is secured in the illustrated position by any suitable means (not shown) as is well known in the art such as an integral depending shank which has been cast within the composition comprising the molded cross-tie 6.

The rail fastener 1, 1' of the present invention is illustrated in the drawing as it would appear when applied adjacent a single rail base flange 8 of a rail R although it will be understood that the fastener assembly is usually applied opposite the two adjacent rail base flanges 8 disposed atop a selected cross-tie and accordingly, the illustrated installations may be considered to be either applied on the field or gage side of a rail R.

Figure 2:
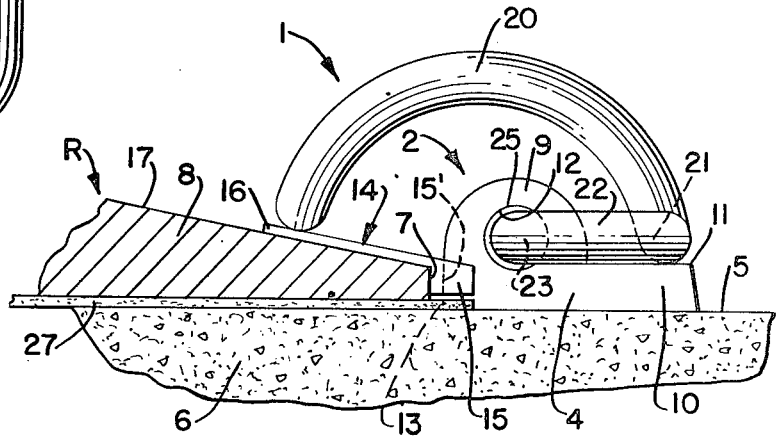
FIG. 2 is an end elevation of a rail fastener including the spring clip of FIG. 1.
Figure 4:
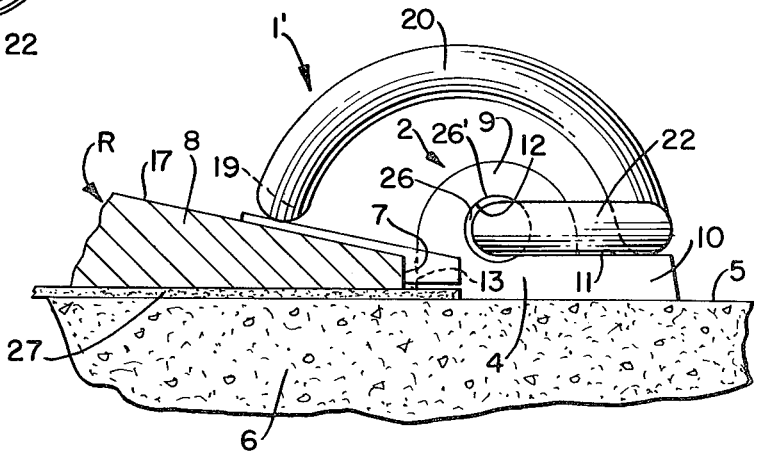
FIG. 4 is an end elevation of a rail fastener employing the spring clip of FIG. 3.

The shoulder or anchor member 2 includes an elevated head 9 disposed adjacent the rail base flange 8 while the shoulder base 4 will be seen to be extended outwardly away from the rail to provide an outer platform 10 having a top surface 11 disposed substantially horizontal. Axially disposed through the shoulder head 9 are attachment and retention means for the clip 3, 3' and which includes a bore 12 having a cylindrical periphery with its central axis disposed parallel to the running length of the rail R. As shown in FIGS. 2 and 4 of the drawing, the bottom of the shoulder bore 12 is disposed substantially in the same horizontal plane as the uppermost portion of the shoulder platform 10 for reasons which will become obvious hereinafter.

When installed, the shoulder members are disposed such that the inner rail facing edge 13 thereof will be slightly spaced from the rail base flange edge 7 so as to provide space for the reception of appropriate insulating means designed to electrically isolate the rail and shoulder at this point. In the embodiment of FIGS. 2 and 4 of the drawing, this insulation comprises the insulation element or block generally designated 14 having an intermediate section 15 disposed between the rail base flange edge 7 and the inner rail facing 13 of the anchor member 2. This insulation block 14 includes a planar top section 16 joined to the intermediate section 15 and overlying the rail base flange top surface 17. The center of the section 15 is notched, as at 15', such that the insulator block straddles the shoulder member 2.

The details of the spring clip 3 or 3', the other major component of the present invention, will now be described. Basically, the Z-shaped configuration of the two spring clips 3 and 3' is similar. Each includes a relatively short innermost rail engaging arm 19 joined to a cross-over arm or loop 20, which when viewed in plan comprises a straight arm joined to the rail engaging arm 19 at an acute internal angle such that the loop 20 is disposed diagonal thereto. As will be seen in the end elevation views of FIGS. 2 and 4 of the drawing, this loop 20 comprises a smooth, substantially constant-radius arc the other end of which is joined to a straight outermost shoulder bearing arm 21 disposed parallel to the rail engaging arm 19. The shoulder bearing arm 21 is substantially longer than the rail engaging arm 19 and the longitudinal extent of the shorter arm 19 will be seen to be disposed laterally between the two limits of the straight portion of the longer shoulder bearing arm 21. The other end of the shoulder bearing arm 21 leads, by means of the semi-circular end connection portion 22, to a mounting or attaching leg 23 or 23', the latter of which will be understood to be parallel to the two arms 19 and 21. Each leg 23 or 23' will be seen to be disposed intermediate the rail engaging arm 19 and shoulder bearing arm 21 with its end 24 extending substantially to a point laterally adjacent the juncture of the arcuate cross-over arm 20 and shoulder bearing arm 21 as seen in the plan views of FIGS. 1 and 3.

Figure 3:
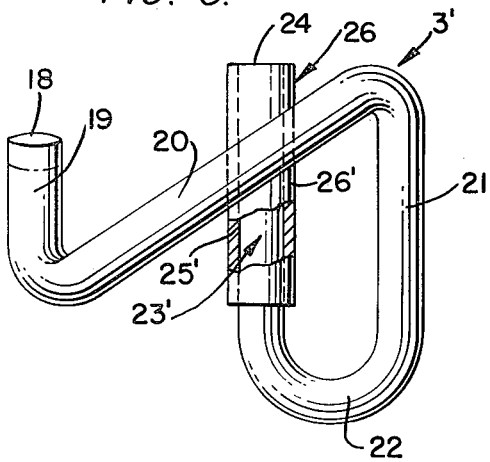
FIG. 3 is a top plan view, partly in section, of a modification of the spring clip.

When in the unassembled, at-rest position as in FIGS. 1 and 3, the spring clips are disposed with the two arms 19 and 21 and the intermediate leg 23 or 23' disposed in one or two different horizontal planes. In some instances the mounting leg may actually be formed such that it will be disposed in a plane slightly above the plane joining the two arms but rarely if ever would the intermediate leg be constructed to be disposed in a plane below that passing through the two arms for reasons which will become apparent hereinafter.

With both spring clips 3, 3', assembly of the rail fastener 1 is achieved by inserting the end 24 of the mounting leg into the shoulder bore 12. Thus, it will be apparent that the diameter of the clip leg and shoulder bore 12 must be compatible to insure a close, sliding fit when installed as shown in FIGS. 2 and 4 of the drawings. In this respect it may be desirable to utilize a relatively large diameter bore 12 in the shoulder 2 in which case only the mounting leg of the clip 3 need be fabricated with an enlarged periphery 25 mating with the selected shoulder bore 12. Various factors would dictate the size of the shoulder bore 12 and spring leg 23 such as holding-force required in any particular installation. Perhaps a greater frictional gripping force between the shoulder and clip leg is required and the increased surface area afforded by an enlarged periphery 25 would meet this requirement.

During the above mentioned insertion of the clip leg into the shoulder bore, the underside of both the rail engaging arm 19 and shoulder bearing arm 21 will bear and slide longitudinally upon the insulation element top section 16 and shoulder platform top surface 11 and it will be understood that any suitable tool means may be utilized to facilitate the required deformation between the elements of the spring clip in order to allow this assembly. The longitudinal displacement of the clip during assembly may be accomplished by an appropriate driving tool. The referenced deformation involves the elevation of the rail engaging arm 19 with respect to the horizontally disposed mounting leg 23 and shoulder bearing arm 21. In this stressed, use position it will now be understood that the elevation of the rail engaging arm 19 and/or the depression of the mounting leg 23 produces a bending of the loop 20 and a downward force by the shoulder bearing arm 21 against the shoulder platform 10 together with a downward force by the rail engaging arm 19.

Figure 5:
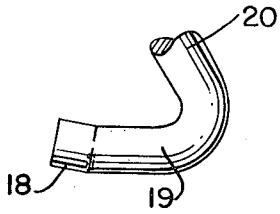
FIG. 5 is a fragmentary side elevation, taken along the line 5—5 of FIG. 1.

The above application of the spring clips is facilitated by the formation of the end 18 of the rail engaging arm 19 in an upwardly bent direction as shown in FIG. 5.

In the modification of FIGS. 3–4, the mounting leg 23' of the clip 3' will be seen to have a periphery 25' which is of the same diameter as the balance of the elements of the spring clip and if the bore 12 of the shoulder member 2 is of the same enlarged diameter as that described herebefore, then the mounting leg 23' will be modified as shown in FIG. 3 of the drawing by the application of enlarging means in the form of the separate metal sleeve 26. Thus, the diameter of the periphery 26' will be selected to provide the necessary close, sliding fit within the bore 12 of the respective shoulder member 2. With either embodiment, an appropriate tie pad 27 is included between the rail and cross-tie.

From the foregoing it will be seen that an improved rail fastener is presented including a spring clip comprising unitary rod stock fabricated to provide parallel inner and outer arms straddling a mounting leg with a cross-over element joining oppositely disposed ends of the two arms and extending straight and diagonally, when viewed in plan, such that the two arms and the cross-over element defines a Z or mirror image thereof.

I claim:

1. A fastener for securing a rail base flange to a cross-tie including, a shoulder member fixed relative said cross-tie and provided with a head disposed atop said cross-tie adjacent said rail base flange, said head provided with clip attachment means, a spring clip having a mounting leg retained by said shoulder member attachment means, an outermost arm parallel to said mounting leg and disposed above and bearing upon said shoulder member, a semi-circular end connection portion joining said mounting leg and outermost arm, an innermost arm disposed above and bearing upon said rail base flange, a cross-over arm joining said outermost arm to said innermost arm and applying a downward force thereto, said cross-over arm in plan view diagonally passing over said mounting leg in a substantially straight line when viewed in plan, said cross-over arm having a medial portion defining the highest point of said clip.

2. A rail fastener according to claim 1 including, an insulation element intermediate said clip and said shoulder member.

3. A rail fastener according to claim 1 including, an insulation element intermediate said clip and said rail base flange.

4. A rail fastener according to claim 1 including, an insulation element intermediate said shoulder member and rail base flange.

5. A rail fastener according to claim 1 wherein, said shoulder member includes an outer platform and said clip outermost arm is disposed atop said platform.

6. A rail fastener according to claim 1 wherein, said attachment means includes a bore in said shoulder member head and said clip mounting leg provides a close fit therewithin.

7. A rail fastener according to claim 1 wherein, said clip comprises a unitary member of metal stock having a circular cross-section.

8. A rail fastener according to claim 1 wherein, said cross-over arm in side elevation view defines an arc of substantially constant radius.

9. A rail fastener according to claim 1 wherein, said clip outermost and innermost arms and said cross-over arm are of similar cross-section, said mounting leg of larger cross-section than said arms and said mounting leg having a cross-section providing a close fit within said shoulder attachment means.

10. A rail fastener according to claim 1 wherein, said clip mounting leg, outermost arm, innermost arm and cross-over arm comprise a unitary metal member having a substantially constant cross-section, and said mounting leg includes an enlarged sleeve thereon having an exterior periphery providing a close mating fit within said shoulder attachment means.

11. A rail fastener according to claim 1 wherein, said clip innermost arm is parallel to said mounting leg and outermost arm.

12. A rail fastener according to claim 11 wherein, said clip outermost and innermost arms and mounting leg are parallel to the running length of said rail base flange.

13. A rail fastener according to claim 11 wherein, said clip innermost and outermost arms and mounting leg are substantially straight throughout their length.

14. A rail fastener according to claim 1 wherein, said clip mounting leg and outermost arm are disposed in a substantially horizontal plane when attached to said shoulder member and said innermost arm is atop said rail base flange at a higher elevation.

15. A rail fastener according to claim 1 wherein, said spring clip arms define a Z configuration in bottom plan view.

* * * * *